US011405724B1

(12) United States Patent
Chang et al.

(10) Patent No.: US 11,405,724 B1
(45) Date of Patent: Aug. 2, 2022

(54) METHOD FOR FEEDFORWARD ACTIVE NOISE CONTROL SYSTEM USING ANALOG FILTER

(71) Applicant: Chung Yuan Christian University, Taoyuan (TW)

(72) Inventors: Cheng-Yuan Chang, Taoyuan (TW); Sen-Maw Kuo, Taoyuan (TW); Wei Hsu, Taoyuan (TW)

(73) Assignee: CHUNG-YUAN CHRISTIAN UNIVERSITY, Taoyuan (TW)

( * ) Notice: Subject to any disclaimer, the term of this patent is extended or adjusted under 35 U.S.C. 154(b) by 0 days.

(21) Appl. No.: 17/313,115

(22) Filed: May 6, 2021

(30) Foreign Application Priority Data

Feb. 24, 2021 (TW) ..... 110106483

(51) Int. Cl.

| | |
|---|---|
| ***H04R 3/04*** | (2006.01) |
| ***G10K 11/178*** | (2006.01) |
| ***H04R 5/04*** | (2006.01) |
| ***H04S 1/00*** | (2006.01) |
| ***H04S 7/00*** | (2006.01) |
| ***H04R 5/033*** | (2006.01) |

(52) U.S. Cl.
CPC ..... *H04R 3/04* (2013.01); *G10K 11/178* (2013.01); *G10K 11/17823* (2018.01); *G10K 11/17854* (2018.01); *G10K 11/17873* (2018.01); *H04R 5/033* (2013.01); *H04R 5/04* (2013.01); *H04S 1/007* (2013.01); *H04S 7/307* (2013.01); *G10K 2210/3027* (2013.01)

(58) Field of Classification Search
CPC ..... G10K 11/17823; G10K 11/17853; G10K 11/17854; G10K 11/17873; G10K 11/17879; G10K 2210/3013; G10K 2210/3027; G10K 2210/3045
USPC ..... 381/71.1, 71.11, 71.13
See application file for complete search history.

(56) References Cited

U.S. PATENT DOCUMENTS 5,852,667 A * 12/1998 Pan ..... G10K 11/17857 381/71.5
6,418,227 B1 * 7/2002 Kuo ..... H04R 3/02 381/71.5
8,565,443 B2 * 10/2013 Wurm ..... G10K 11/17825 381/71.8
8,693,700 B2 * 4/2014 Bakalos ..... H04R 1/1083 381/74

(Continued)

*Primary Examiner* — Xu Mei

(57) ABSTRACT

A design method for feedforward active noise control (ANC) system using analog filter. In which, at least one noise collecting system is adopted for collecting a real environmental noise for obtaining a reference signal and a target signal. According to the reference signal and the target signal, a first adaptive system identifying unit is enabled to complete a system identification process for producing a first adaptive filter. After that, a second adaptive system identifying unit is enabled to complete a system identification process based on the reference signal, the target signal and the first adaptive filter for producing a second adaptive filter. After the second adaptive filter is converted to a low-order digital filter, the digital filter is further converted to a physical analog filter circuit. Consequently, a feedforward ANC system comprising the physical analog filter circuit, a pre-amplifier unit, a reference microphone, and a mixer is established.

10 Claims, 9 Drawing Sheets

(56) References Cited

U.S. PATENT DOCUMENTS

| | | | | |
|---|---|---|---|---|
| 10,235,987 | B1 * | 3/2019 | Valeri | G10K 11/17823 |
| 2004/0086135 | A1 * | 5/2004 | Vaishya | G10K 11/17853<br>381/86 |

* cited by examiner

METHOD FOR FEEDFORWARD ACTIVE NOISE CONTROL SYSTEM USING ANALOG FILTER

BACKGROUND OF THE INVENTION

1. Field of the Invention

The present invention relates to the technology field of environment noise attenuating, and more particularly to a design method for feedforward active noise control system using analog filter.

2. Description of the Prior Art

The development of technology along with the advancement in science helps to bring in fast industrial manufacture, having good transport facilities and high tech electronic products, but also leads noise pollution to blanket the living environment. It should be known that, sound (noise) is measured in a unit called decibel (dB) or A-weighted decibels (dBA). For example, sound produced by an ordinary conversation is about 60 dBA. On the other hand, by using a decibel meter, it can be measured that fridge noise and air conditioner's operation noise are both around 60 dBA. Moreover, noises make by car horns, railway train, police sirens and take-off of airplanes are measured in a range between 100 dBA and 130 dBA. Not only that, there are also noise pollution blanketing the rural environment, including noise of leaf blower operation (~110 dBA), noise of grain dryer operation (82-102 dBA) and noise of manure spreader operation (90-105 dBA).

From above descriptions, it is understood that, how to effectively attenuate environmental noises have now become an important issue. Currently, passive noise control (PNC) and active noise control (ANC) are two principal noise attenuating ways, and the ANC technique has been widely applied in noise attenuation because of the good development of adaptive signal processing techniques and digital signal processors (DSPs). For example, Hyundai motor company utilizes the ANC technique to attenuate engine noise, and Noctua (company) applies the ANC technique in noise attenuation of radiator fan.

FIG. 1 illustrates a framework diagram of a conventional ANC system. The conventional ANC system 1' comprises: a reference microphone 1RM' for collecting a noise signal, two pre-amplifier units 13', two antialiasing filter units 14', a DSP chip 1DP', a reconstruction filter unit 11', a power amplifier 12', a loudspeaker 1LS', and an error microphone 1EM'. As described in more detail below, the DSP chip 1DP' is provided with an adaptive filter and an adaptive algorithm unit for updating the adaptive filter therein. By such arrangement, after the reference microphone 1RM' transmits a reference signal to the DSP chip 1DP', the DSP chip 1DP' achieves an active noise control (ANC) computing base on the reference signal and an error signal, and then produces and transmits an output signal to the loudspeaker 1LS'. Consequently, the loudspeaker 1LS' broadcasts an anti-noise audio to a predetermined quiet zone according to the output signal. As explained in more detail below, the error microphone 1EM' is adopted for collecting a residual noise signal in the quiet zone so as to transmit the error signal to the DSP chip 1DP'. Therefore, the DSP chips 1DP' utilizes the adaptive algorithm unit to complete the ANC computing based on a preciously-produced output signal and the error signal, and then updates the adaptive filter based on the computing result.

During a normal operation of the ANC system 1', however, the causality constraint will be violated in case of the acoustic/electric delays in the ANC system 1' exceeding the acoustic delay of the primary path. As a result, the noise attenuating performance of the ANC system 1' dramatically degrades as the degree of noncausality increases. Thus, the positions of the noise source, the reference microphone 1RM' and the error microphone 1EM' are critical when designing and manufacturing the ANC system 1' in order to improve the noise attenuating performance.

As explained in more detail below, the primary path starts at the position of the reference microphone 1RM' and ends at the position of the error microphone 1EM'. On the other hand, ANC technique follows the principle of the destructive wave interference, reducing an unwanted acoustic noise generated by a primary source through an anti-noise produced by a secondary source. The secondary path is composed by the transfer functions of the error microphone 1EM', the pre-amplifier 13', the anti-aliasing filter 14', the analog-to-digital converter (ADC) in the DSP chip 1DP', the digital-to-analog converter (DAC) in the DSP chip 1DP', the reconstruction filter 11', the power amplifier 12', the loudspeaker 1LS', and the acoustic path from loudspeaker 1LS' to error microphone 1EM'. Therefore, computing the secondary path's transfer function (i.e., S(z)) lead the computing loading of the DSP chip 1DP' to become heavy. As a result, not only the DSP chip 1DP' needs spending even more time to achieve the convergence of the ANC computing, but also the adaptive filter is updated to be a high-order filter. However, heavy computing loading of the adaptive algorithm would enlarge the electronic delay in case of the design of the ANC system is in consideration of the causality constraint of the acoustic delay of the primary path and the electronic delay of the secondary path.

Therefore, resulted from the fact that the design of the circuit and/or the constituting units of the DSP chip 1DP' is too complicated, a noise-cancelling earbuds or a noise-canceling headset using the conventional ANC system 1' show cannot show a satisfying price-performance ratio. In addition, because the adaptive filter provided in the DSP chip 1DP' is a high-order digital filter, it is impossible to design a physical analog circuit for disposing in the DSP chip 1DP' to execute the same filter function as the high-order digital filter.

From above descriptions, it is understood that there are rooms for improvement in the conventional ANC system 1'. In view of that, inventors of the present application have made great efforts to make inventive research and eventually provided a design method for feedforward active noise control system using analog filter.

SUMMARY OF THE INVENTION

The primary objective of the present invention is to disclose a design method for feedforward active noise control (ANC) system using analog filter. In which, at least one noise collecting system is adopted for collecting a real environmental noise so as to generate a reference signal and a target signal. Subsequently, according to the reference signal and the target signal, a first adaptive system identifying unit is enabled to complete a first system identification process for producing a first adaptive filter. After that, a second adaptive system identifying unit is enabled to complete a second system identification process based on the reference signal, the target signal and the first adaptive filter so as to produce a second adaptive filter. Then, after the second adaptive filter is converted to a low-order digitally-controlled filter by using a system identification tool, the digitally-controlled filter is further converted to a physical analog filter circuit. Consequently, a feedforward ANC system comprising the physical analog filter circuit, a pre-amplifier unit, a reference microphone, and a mixer is established.

It is worth mentioning that, because the feedforward ANC system not includes any DSP chip, analog-to-digital converter and digital-to-analog converter, it is able to find that the feedforward active noise control system can not only exhibit an outstanding noise cancelling ability, but also has an advantage of low manufacturing cost.

In order to achieve the primary objective of the present invention, inventors of the present invention provides an embodiment of the design method for feedforward active noise control system, comprising following steps:

(1) recording a real environmental noise;

(2) establishing a first noise collecting system to receive a first analog reference signal that is acquired from the real environmental, and then generating a first digital reference signal and a digital target signal;

(3) letting the first noise collecting system transmit the first digital reference signal and the digital target signal to a first system identifying unit having a first adaptive filter, and then enabling the first system identifying unit to complete an adaptive system identification of the first adaptive filter;

(4) establishing a second noise collecting system to receive a first analog reference signal that is acquired from the real environmental, and then generating a first digital reference signal and a digital target signal;

(5) letting the second noise collecting system transmit the first digital reference signal and the digital target signal to a second system identifying unit having a second adaptive filter, and then enabling the second system identifying unit to complete an adaptive system identification of the second adaptive filter;

(6) converting the second adaptive filter to an analog filter by using a system identification tool, wherein the analog filter is a low-order filter; and (7) establishing a feedforward active noise control system comprising: a physical analog filter circuit, a first pre-amplifier unit coupled to the physical analog filter circuit, a first microphone coupled to the first pre-amplifier unit, a mixer coupled to the physical analog filter circuit and an audio signal, and a loudspeaker coupled to the mixer.

In one embodiment, the forgoing second noise collecting system comprises:

a noise source for broadcasting the real environmental noise by a form of an environmental noise signal;

a first audio collecting device, being disposed at a position so as to face a non-audio broadcasting side of an audio broadcasting device, thereby collecting the environmental noise signal; wherein the non-audio broadcasting side of the audio broadcasting device faces a quiet zone;

a first pre-amplifier, being coupled to the first audio collecting device, and being used for applying a signal pre-amplifying process to the environmental noise signal, so as to output the first analog reference signal;

a second audio collecting device, being disposed at a center position of the quiet zone, so as to collect a first audio signal in the quiet zone;

a second pre-amplifier, being coupled to the second audio collecting device, and being used for applying a signal pre-amplifying process to the first audio signal;

a first A/D conversion circuit, being coupled to the first pre-amplifier for converting the first analog reference signal to the first digital reference signal; and a second A/D conversion circuit, being coupled to the second pre-amplifier for converting the first audio signal to the target signal.

In one embodiment, the forgoing first noise collecting system also comprises a second pre-amplifier, a first A/D conversion circuit, and a second A/D conversion circuit, and further comprises:

an analog filter, receiving the first analog reference signal, and being also coupled to the audio broadcasting device.

In one embodiment, the forgoing first system identifying unit comprises:

the forgoing first adaptive filter, receiving the first analog reference signal;

a first adaptive algorithm unit, being coupled to the first adaptive filter, and receiving the first digital reference signal; and a first digital subtracter, being coupled to the first ANC algorithm unit and the first adaptive filter, and receiving the digital target signal;

wherein the first adaptive filter produces a first digital output signal based on the first digital reference signal, and the first digital subtracter applying a subtraction operation to the first digital output signal and the digital target signal so as to produce a first digital error signal;

wherein the first adaptive algorithm unit adaptively modulates at least one filter parameter of the first adaptive filter according to the first digital error signal and the first digital reference signal, thereby making the first digital error signal approach zero.

In one embodiment, the forgoing second system identifying unit comprises:

the forgoing second adaptive filter, receiving the first digital reference signal, and also generating a first digital output signal;

two of the forgoing first adaptive filters, wherein one of the two first adaptive filters is coupled to the second adaptive filter for receiving the first digital output signal so as to generate a second digital output signal, and the other one first adaptive filters being coupled to the first digital reference signal so as to generate a second digital reference signal;

a second digital subtracter, being coupled to the digital target signal and the second digital output signal; and a second adaptive algorithm unit, being coupled to the second adaptive filter, the second digital reference signal, and the second digital subtracter;

wherein the second digital subtracter applies a subtraction operation to the second digital output signal and the digital target signal, so as to produce and transmit a second digital error signal to the second adaptive algorithm unit;

wherein the second adaptive algorithm unit adaptively modulates at least one filter parameter of the second adaptive filter according to the second digital error signal and the second digital reference signal, thereby making the second digital error signal approach zero.

In a practicable embodiment, the forgoing system identification tool is a mathematical program such as a C programming language.

In a practicable embodiment, the forgoing physical analog filter circuit comprises a plurality of low-order filters coupled to each other by a cascade connecting way.

In a practicable embodiment, the first adaptive filter and the second adaptive filter are both a finite impulse response (FIR) filter, and the analog filter W(s) is an infinite impulse response (IIR) filter.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a design method for feedforward active noise control system disclosed by the present invention, embodiments of the present invention will be described in detail with reference to the attached drawings hereinafter.

The present invention discloses a design method for feedforward active noise control system using analog filter In which, at least one noise collecting system is adopted for collecting a real environmental noise so as to generate a reference signal and a target signal. Subsequently, according to the reference signal and the target signal, a first adaptive system identifying unit is enabled to complete a first system identification process for producing a first adaptive filter. After that, a second adaptive system identifying unit is enabled to complete a second system identification process based on the reference signal, the target signal and the first adaptive filter so as to produce a second adaptive filter. Then, after the second adaptive filter is converted to a low-order digitally-controlled filter by using a system identification tool, the digitally-controlled filter is further converted to a physical analog filter circuit. Consequently, a feedforward ANC system comprising the physical analog filter circuit, a pre-amplifier unit, a reference microphone, and a mixer is established.

Figure 1:
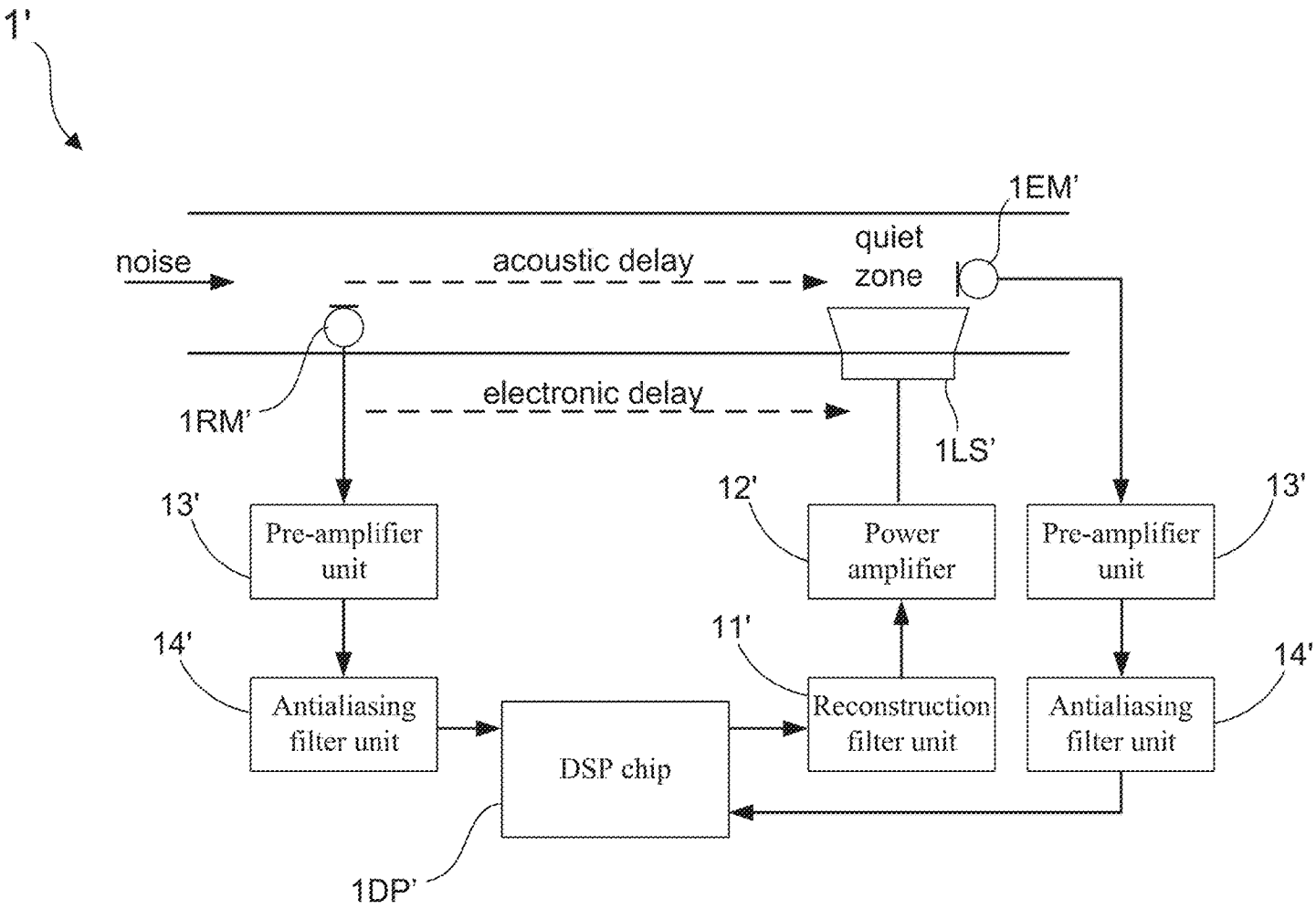
FIG. 1 (Prior art)
FIG. 1 shows a framework diagram of a conventional ANC system.
Figure 2:
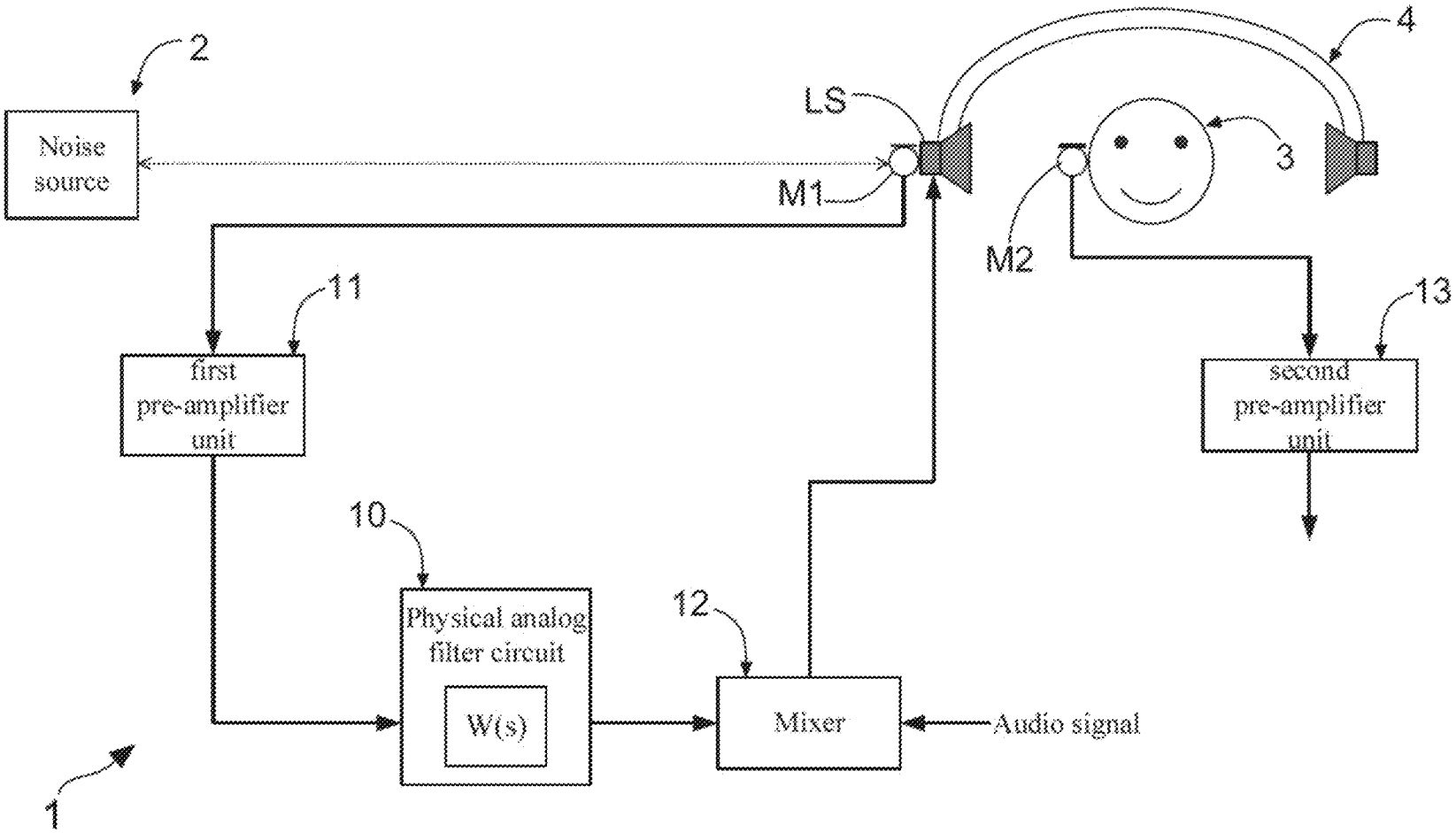
FIG. 2 shows a block diagram of a feedforward active noise control system having an analog filter circuit and established by using a design method for feedforward active noise control system according to the present invention.

With reference to FIG. 2, there is shown a block diagram of a feedforward active noise control system having an analog filter circuit and established by using a design method for feedforward active noise control system according to the present invention. As FIG. 2 shows, the feedforward active noise control (ANC) system 1 comprises: a physical analog filter circuit 10, a first pre-amplifier unit 11 coupled to the physical analog filter circuit 10, a first microphone M1 coupled to the first pre-amplifier unit 11, a mixer 12 coupled to the physical analog filter circuit 10 and an audio signal, and a loudspeaker LS coupled to the mixer 12. It is worth noting that, FIG. 3 also depicts a second microphone M1 (i.e., error microphone) and a second pre-amplifier unit 13 coupled to the second microphone M1. However, because the feedforward ANC system 1 not includes any DSP chip, analog-to-digital converter and/or digital-to-analog converter, there is no need to use the second microphone M1 and the second pre-amplifier unit 13 when the feedforward ANC system 1 having the physical analog filter circuit 10 is implemented into an electronic device like the headphones 4 shown in FIG. 2.

Figure 3A:
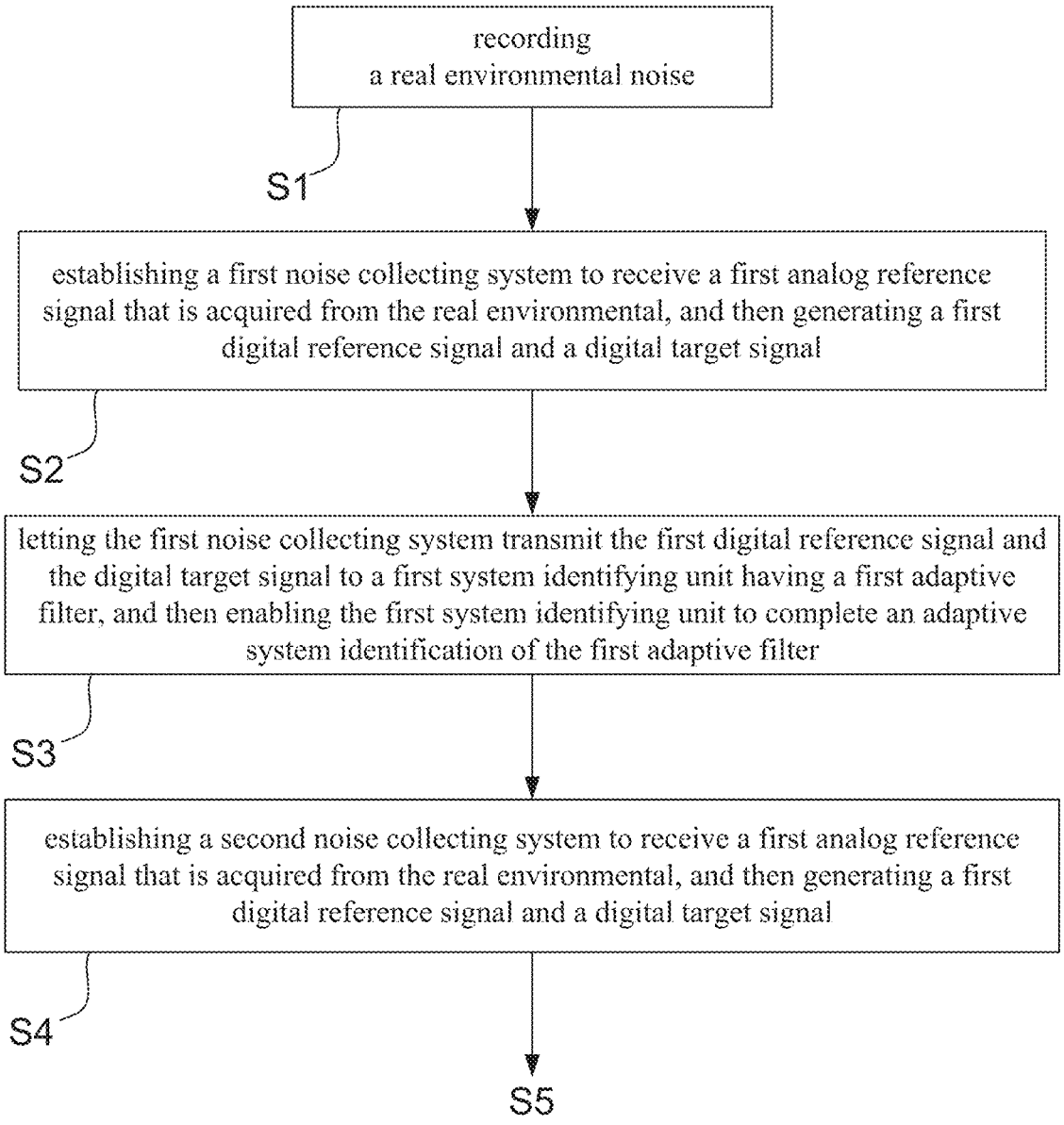
FIG. 3A and FIG. 3B show flowchart diagrams of a design method for feedforward active noise control system according to the present invention.
Figure 3B:
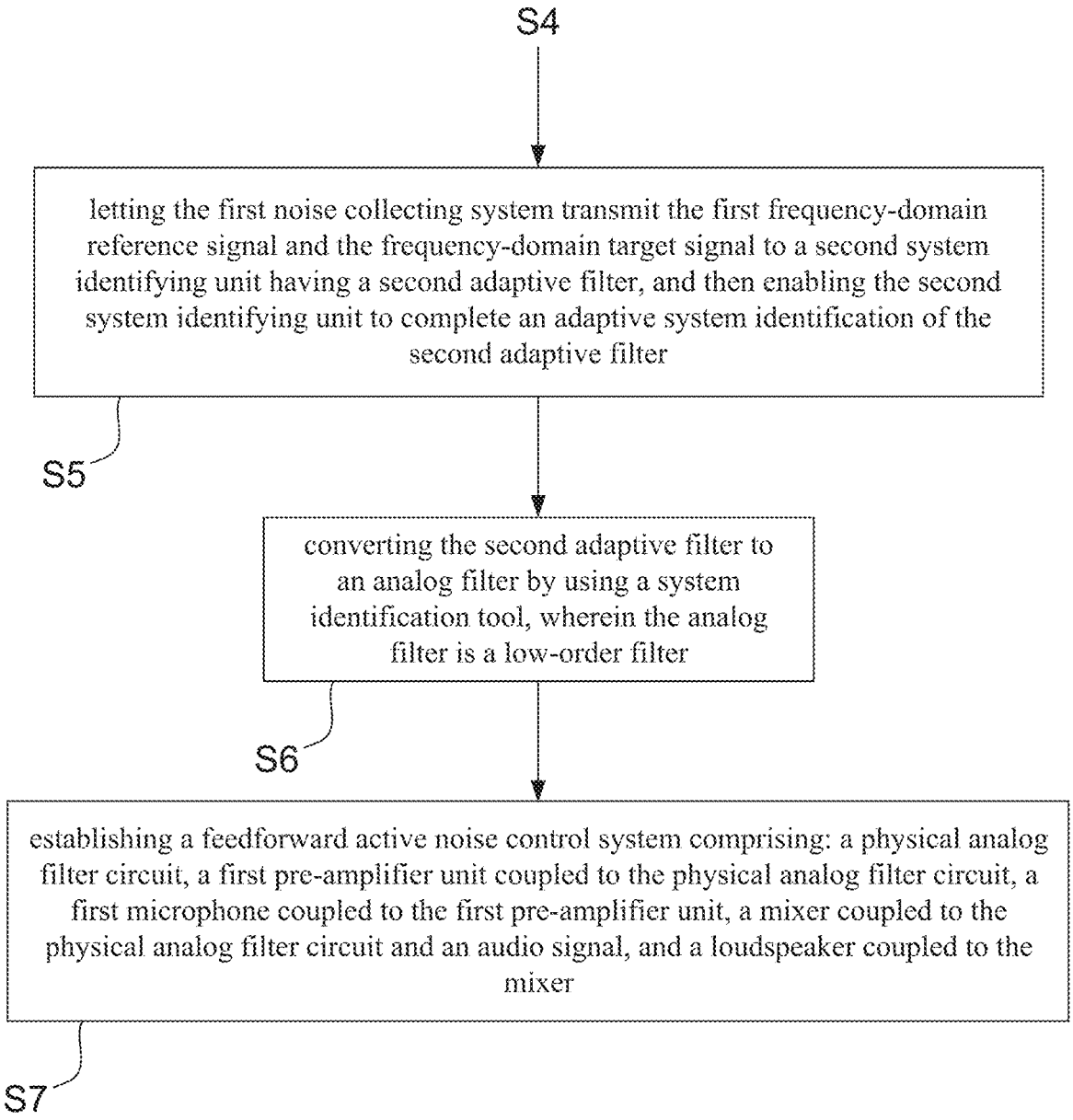
Figure 4:
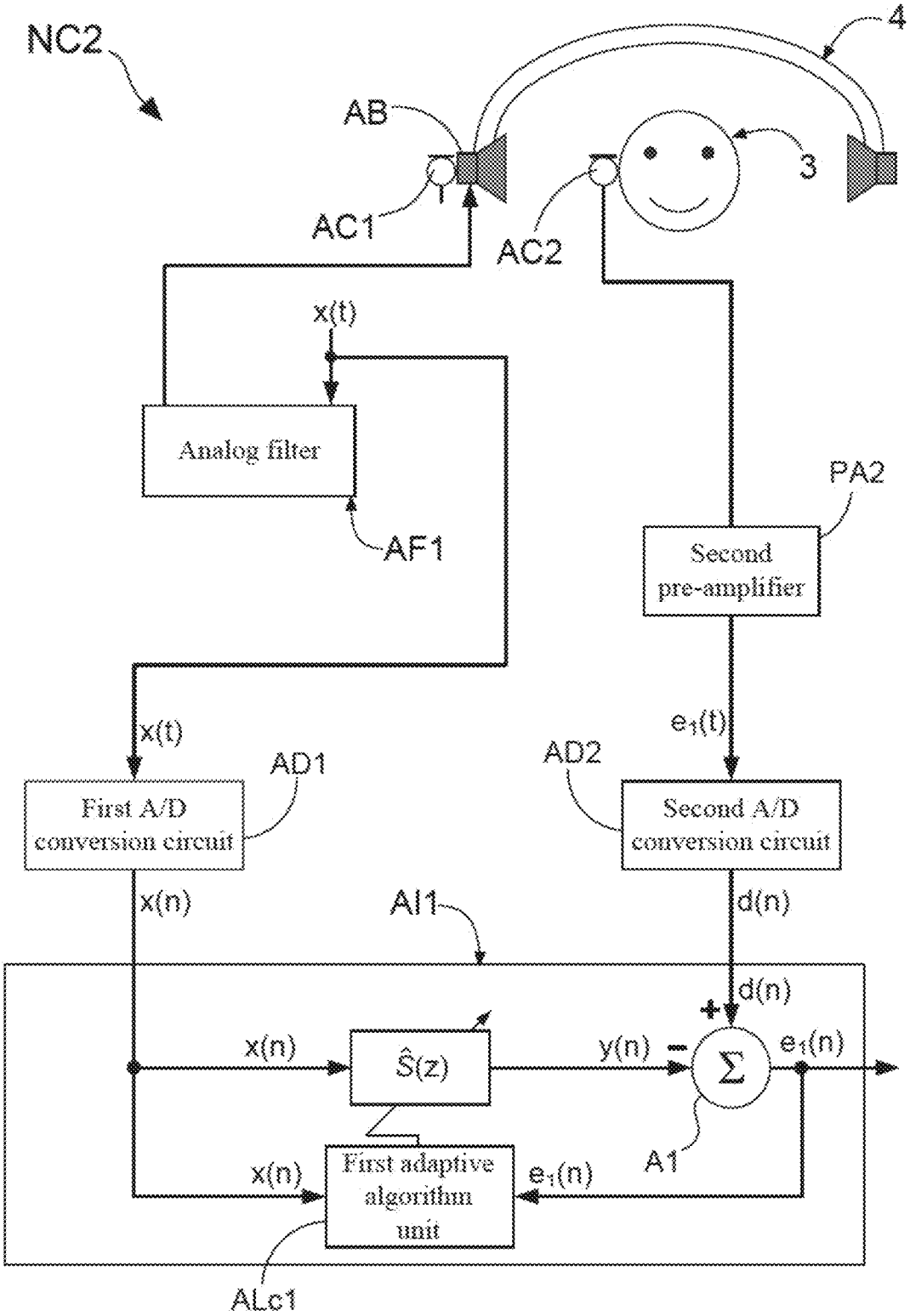
FIG. 4 shows a block diagram of a first noise collecting system.

FIG. 3A and FIG. 3B show flowchart diagrams of a design method for feedforward active noise control system according to the present invention. As FIG. 3A shows, the design method is firstly executed step S1: recording a real environmental noise. Subsequently, step S2 is executed so as to establishing a first noise collecting system NC2 to receive a first analog reference signal x(t) that is acquired from the real environmental, and then generating a first digital reference signal x(n) and a digital target signal d(n). FIG. 4 shows a block diagram of a first noise collecting system. As FIG. 4 shows, the first noise collecting system NC2 comprises an analog filter AF1, a first audio collecting device AC1, a second audio collecting device AC2, a first A/D conversion circuit AD1, and a second A/D conversion circuit AD2.

As explained in more detail below, the first noise collecting system NC2 is developed for acquiring the first digital reference signal x(n) and the digital target signal d(n) that are transmitted in the primary path P(z). As FIG. 4 shows, the analog filter AF1 is coupled to a first analog reference signal x(t) that is acquired from the real environmental, and is also coupled to an audio broadcasting device AB. On the other hand, the first A/D conversion circuit AD1 is configured to receive the first analog reference signal x(t), and then generates a first digital ref configured to reference signal x(n). Moreover, the second A/D conversion circuit AD2 is receive a first signal (i.e., first analog error signal) from the second audio collecting device AC2, so as to generates a digital target signal d(n).

Subsequently, method flow is proceeded to step S3, so as to let the first noise collecting system NC2 transmit the first digital reference signal x(n) and the digital target signal d(n) to a first system identifying unit AI1 having a first adaptive filter $\hat{S}(z)$, and then enabling the first system identifying unit AI1 to complete an adaptive system identification of the first adaptive filter $\hat{S}(z)$. As FIG. 4 shows, the first system identifying unit AI1 comprises: a first adaptive filter $\hat{S}(z)$, a first adaptive algorithm unit ALc1 and a first digital subtracter A1, wherein the first adaptive filter g (z) receives the first analog reference signal x(n). Moreover, the first adaptive algorithm unit ALc1 is coupled to the first adaptive filter $\hat{S}(z)$, and receives (is coupled to) the first digital reference signal x(n). As described in more detail below, the first digital subtracter A1 is coupled to the first adaptive algorithm unit ALc1 and the first adaptive filter $\hat{S}(z)$, and receives the digital target signal d(n).

Therefore, during executing the step S3, the first adaptive filter $\hat{S}(z)$ produces a first digital output signal y(n) based on the first digital reference signal x(n), and the first digital subtracter A1 applies a subtraction operation to the first digital output signal y(n) and the digital target signal d(n) so as to produce a first digital error signal $e_1(n)$. Subsequently, the first adaptive algorithm unit ALc1 adaptively modulates at least one filter parameter of the first adaptive filter $\hat{S}(z)$ according to the first digital error signal $e_1(n)$ and the first digital reference signal x(n), thereby making the first digital error signal $e_1(n)$ approach zero.

In a practicable embodiment, the first adaptive algorithm unit ALc1 is an algorithm, such as least mean square (LMS) algorithm, normalized least mean square (NLMS) algorithm or Filtered-x LMS algorithm. Of course, the first adaptive algorithm unit ALc1 provided in the first system identifying unit AI1 is not limited to be the forgoing LMS, NLMS or Filtered-x LMS. In other words, engineers skilled in development and manufacture of ANC system should know that, there are many other mathematical algorithms suitable for being used as the first adaptive algorithm unit ALc1. On the other hand, the first adaptive filter $\hat{S}(z)$ can be a finite impulse response (FIR) filter or an infinite impulse response (IIR) filter. For example, when using LMS algorithm as the first adaptive algorithm unit ALc1 so as to be provided in the first system identifying unit AI1, it utilizes following mathematical formulas to complete the adaptive system identification of the first adaptive filter $\hat{S}(z)$:

$$y(n) = \sum_{l=0}^{L-1} \hat{S}_l(n) \cdot x(n-l); \tag{I}$$

$$e_1(n) = d(n) - y(n); \text{ and} \tag{II}$$

$$\hat{S}_l(n+1) = \hat{S}_l(n) + \mu x(n-1) e_1(n). \tag{III}$$

In the above-listed mathematical formulas, y(n) is the first digital output signal, d(n) is the digital target signal, x(n) is the first digital reference signal, $e_1(n)$ is the first digital error signal, $\hat{S}_1$ (n) is a weight vector, μ is a step size of the first adaptive filter $\hat{S}(z)$, and L is a length of the first adaptive filter $\hat{S}(z)$. That is, after the adaptive system identification of the first adaptive filter $\hat{S}(z)$ is completed, an estimated transfer function of the secondary path S(z) (i.e., the first adaptive filter $\hat{S}(z)$) is acquired.

Figure 5:
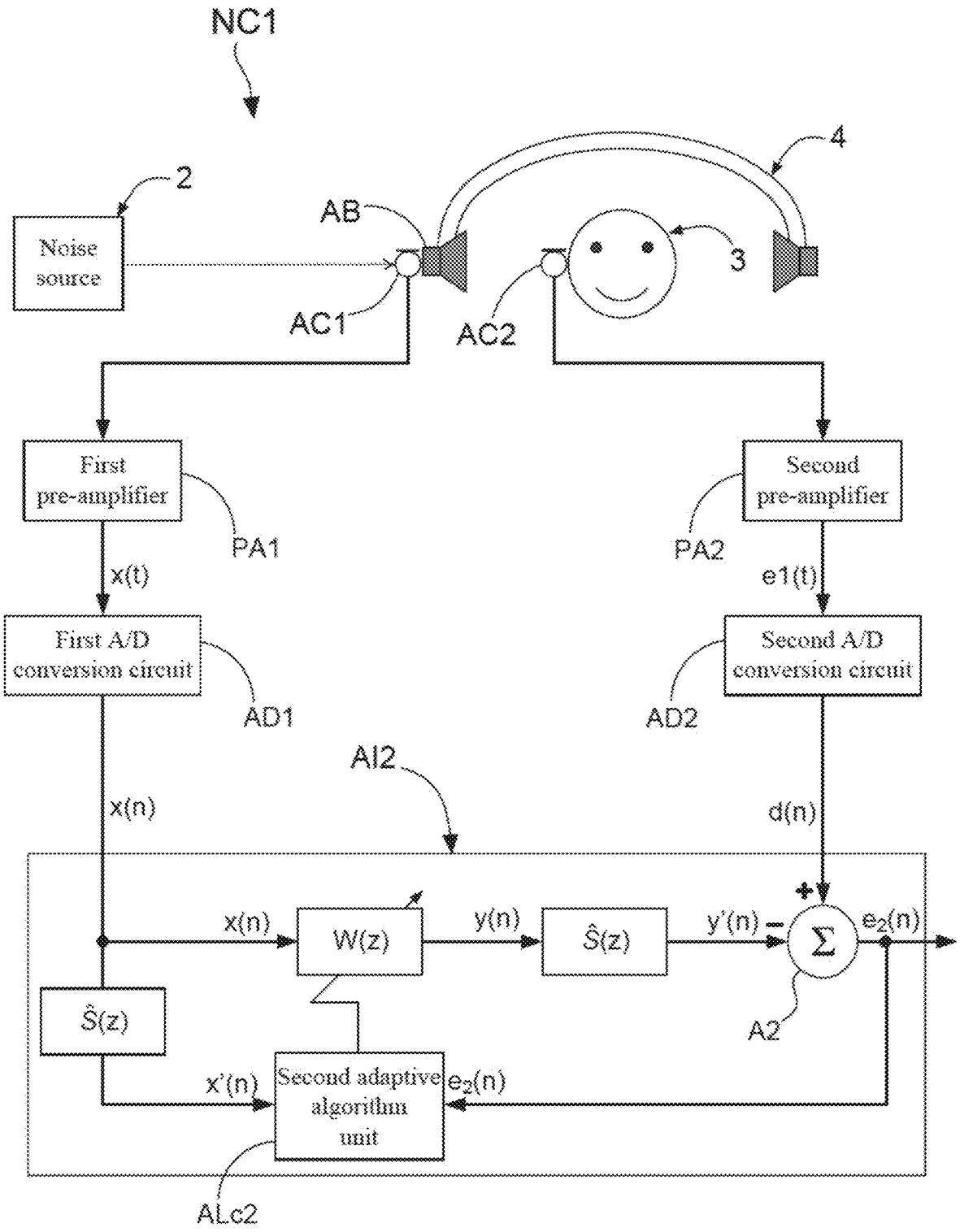
FIG. 5 shows a block diagram of a second noise collecting system.

After completing the step S3, step S4 is then executed for establishing a second noise collecting system NC1 to receive a first analog reference signal x(t) that is acquired from the real environmental, and then generating a first digital reference signal x(n) and a digital target signal d(n). FIG. 5 shows a block diagram of a second noise collecting system NC1. As FIG. 5 shows, the second noise collecting system NC1 comprises a first audio collecting device AC1, a second audio collecting device AC2, a first pre-amplifier PA1, a second pre-amplifier PA2, a first A/D conversion circuit AD1, and a second A/D conversion circuit AD2.

The first audio collecting device AC1, functioning like the first microphone M1 of FIG. 2, is disposed at a position for being faced a non-audio broadcasting side of an audio broadcasting device AB, so as to collect the environmental noise signal. As FIG. 4 shows, the non-audio broadcasting side of the audio broadcasting device AB faces a quiet zone (i.e., right ear of the KEMAR head 3). Moreover, the first pre-amplifier AP1 is coupled to the first audio collecting device AC1, and is used for applying a signal pre-amplifying process to the environmental noise signal, so as to output the first analog reference signal x(t). On the other hand, the first A/D conversion circuit AD1 is coupled to the first pre-amplifier PA1 for converting the first analog reference signal x(t) to the first digital reference signal x(n).

As FIG. 5 shows, the second audio collecting device AC2, functioning like an error microphone, is disposed at a center position of the quiet zone, so as to collect a first audio signal (i.e., analog error signal) in the quiet zone. Moreover, the second pre-amplifier AP2 is coupled to the second audio collecting device AC2, and is used for applying a signal pre-amplifying process to the first audio signal. FIG. 4 also depicts that the second A/D conversion circuit AD2 is coupled to the second pre-amplifier PA2 for converting the first audio signal to the target signal d(n).

After completing the step S4, step S5 is next executed for letting the second noise collecting system NC1 transmit the first digital reference signal x(n) and the digital target signal d(n) to a second system identifying unit AI2 having a second adaptive filter W(z), and then enabling the second system identifying unit AI2 to complete an adaptive system identification of the second adaptive filter W(z). As FIG. 5 shows, the second system identifying unit AI2 comprises: a second adaptive filter W(z), two first adaptive filters $\hat{S}(z)$, a second digital subtracter A2, and a second adaptive algorithm unit ALc2.

As described in more detail below, the second adaptive filter W(z) receives the first digital reference signal x(n), and is configured for also generating (outputting) a first digital output signal y(n). Herein, it needs to note that, one of the two first adaptive filters $\hat{S}(z)$ is coupled to the second adaptive filter W(z) for receiving the first digital output signal y(n) so as to generate a second digital output signal y'(n). On the other hand, the other one first adaptive filters $\hat{S}(z)$ is coupled to the first digital reference signal x(n) so as to generate a second digital reference signal x'(n). Moreover, the second digital subtracter A2 is coupled to the digital target signal d(n) and the second digital output signal y'(n), and the second adaptive algorithm unit ALc2 is coupled to the second adaptive filter W(z), the second digital reference signal x'(n), and the second digital subtracter A2. Therefore, during executing the step S5, the second digital subtracter A2 applies a subtraction operation to the second digital output signal y'(n) and the digital target signal d(n), so as to produce and transmit a second digital error signal $e_2(n)$ to the second adaptive algorithm unit ALc2. Subsequently, the second adaptive algorithm unit ALc2 adaptively modulates at least one filter parameter of the second adaptive filter W(z) according to the second digital error signal $e_2(n)$ and the second digital reference signal x'(n), thereby making the second digital error signal $e_2(n)$ approach zero.

In a practicable embodiment, the second adaptive algorithm unit ALc2 is an algorithm, such as least mean square (LMS) algorithm, normalized least mean square (NLMS) algorithm or Filtered-x LMS algorithm. Of course, the second adaptive algorithm unit ALc2 provided in the second system identifying unit AI2 is not limited to be the forgoing LMS, NLMS or Filtered-x LMS. In other words, engineers skilled in development and manufacture of ANC system should know that, there are many other mathematical algorithms suitable for being used as the second adaptive algorithm unit ALc2. On the other hand, the second adaptive filter w(z) can be a finite impulse response (FIR) filter or an infinite impulse response (IIR) filter. For example, when using LMS algorithm as the second adaptive algorithm unit ALc2 so as to be provided in the second system identifying unit AI1, it utilizes following mathematical formulas to complete the adaptive system identification of the second adaptive filter w(z):

$$y(n) = \sum_{l=0}^{L-1} w_l(n) \cdot x(n-l); \tag{IV}$$

$$e_2(n) = d(n) - y'(n); \tag{V}$$

$$x'(n) = \sum_{m=0}^{M-1} \hat{S}_m(n) \cdot x(n-m); \text{ and} \tag{VI}$$

$$w_l(n+1) = w_l(n) + \mu x'(n-1) e_2(n). \tag{VI}$$

In the above-listed mathematical formulas, y(n) is the first digital output signal, y'(n) is the second digital output signal, d(n) is the digital target signal, x(n) is the first digital reference signal, x'(n) is the second digital reference signal, $e_2(n)$ is the second digital error signal, $w_l(n)$ is a weight vector, $\hat{S}_m(n)$ is a weight vector, μ is a step size of the second adaptive filter W'(z), and L and M are both a filter length.

Figure 6:
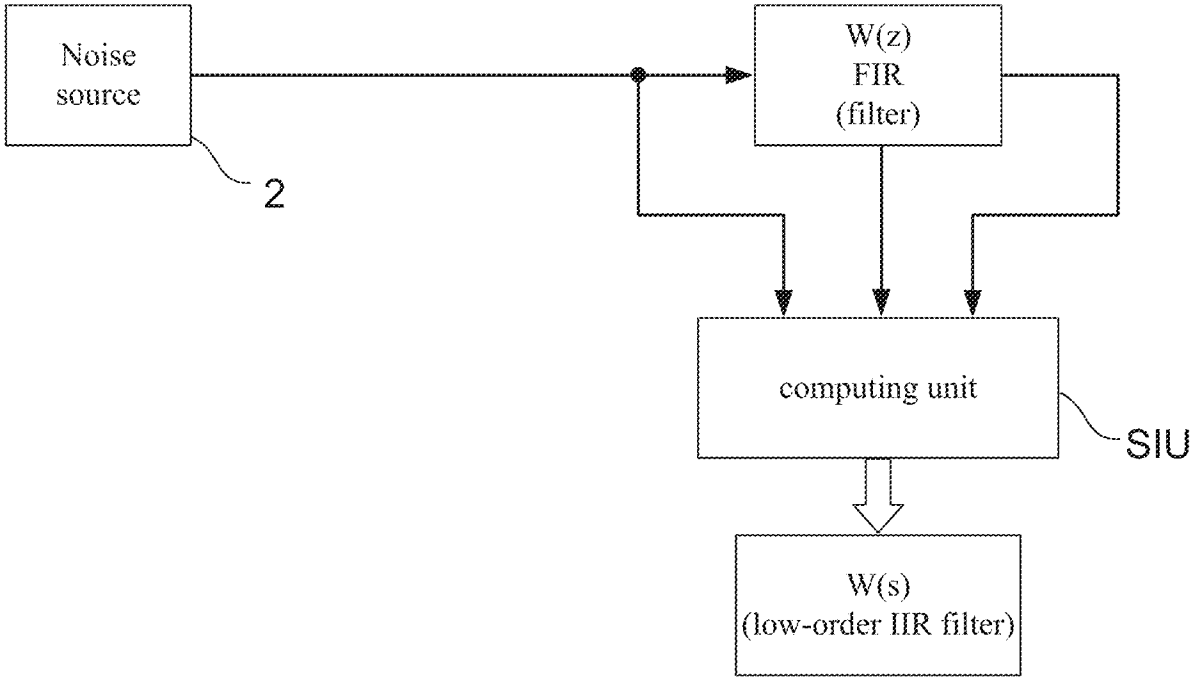
FIG. 6 shows a block diagram of a system identification system for use in production of an analog filter.
Figure 7:
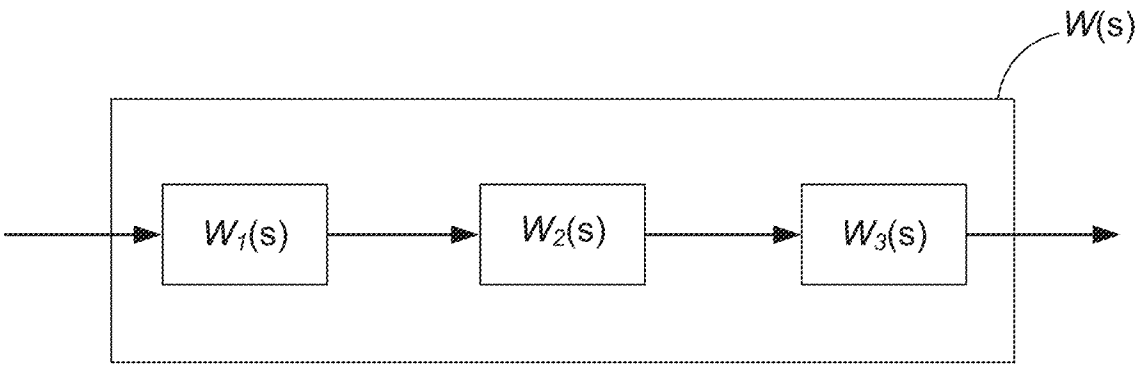
FIG. 7 shows a block diagram of the analog filter comprising three 2-order filter units.

After completing the step S5, step S6 is next executed for converting the second adaptive filter W(z) to an analog filter W(s) by using a system identification tool, wherein the analog filter W(s) is a low-order filter. The system identification tool is a mathematical program like C programming language, and functions as a system identification system as shown in FIG. 6. As FIG. 6 shows, the system identification system constructed by using the system identification tool comprises a noise source 2, a second adaptive filter W(z) and a computing unit SIU. Therefore, during executing the step S6, the noise source 2 provides an environmental noise signal to the second adaptive filter W(z) (e.g., FIR filter), and then a plurality of first digital reference signal x(n) inputted to the second adaptive filter W(z) and a plurality of first digital output signal y(n) outputted by the second adaptive filter W(z) are subsequently inputted to the computing unit SIU. Consequently, after completing a system identification operation of an equivalent analog filter based on the plurality of first digital reference signal x(n) and the first digital output signal y(n), the equivalent analog filter w(s) is therefore produced.

As FIG. 3B shows, the method is consequently proceeded to step S7, so as to establish a feedforward ANC system 1 (as shown in FIG. 2) comprising: a physical analog filter circuit 10, a first pre-amplifier unit 11 coupled to the physical analog filter circuit 10, a first microphone coupled to the first pre-amplifier unit 11, a mixer 12 coupled to the physical analog filter circuit 10 and an audio signal, and a loudspeaker LS coupled to the mixer 12.

In an exemplary embodiment, the analog filter w(s) is a 6-order filter, such that it is hard to convert the analog filter w(s) to a physical analog filter circuit. Accordingly, the mathematical program is utilized again in order to further convert the analog filter w(s) to an analog filter comprising three low-order filter unit coupled to each other by a cascade connecting way.

Figure 8:
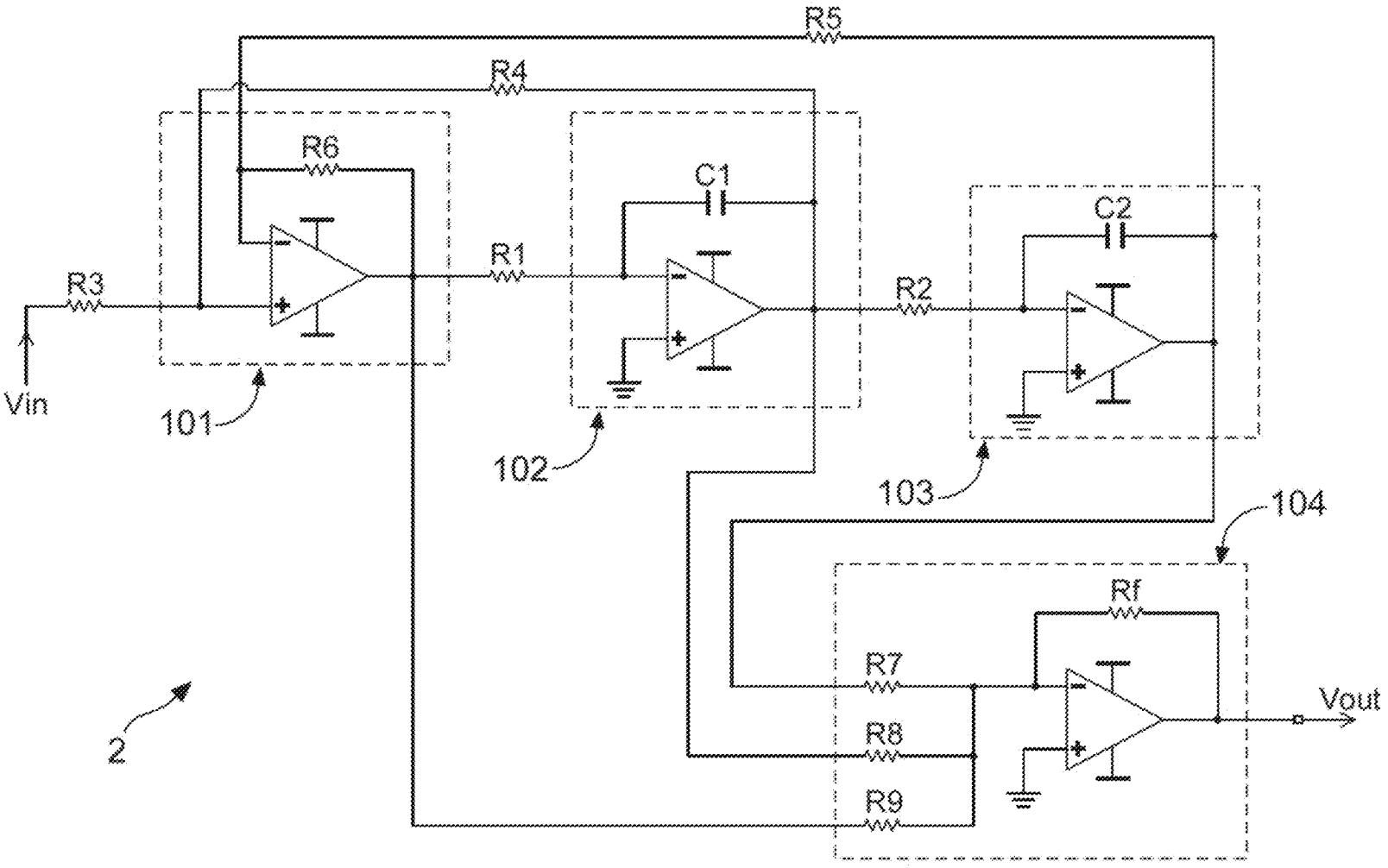
FIG. 8 shows a circuit topology diagram of a KHN filter.

After the analog filter comprising three cascade-connected low-order filter units is obtained, the analog filter is consequently converted to a KHN (Kerwin-Huelsman-Newcomb) filter circuit for being as the physical analog filter circuit 10. As FIG. 8 shows, the KHN filter circuit 2 comprises: a non-inverting buffer 101, a first integrator 102, a second integrator 103, and an adder 104. In which, a resistor R3 is coupled between an input signal Vin and the non-inverting buffer 101, a resistor R2 is coupled between the first integrator 102 and the second integrator 103. Moreover, a resistor R4 is coupled between a first signal inputting terminal of the non-inverting buffer 101 and a signal inputting terminal of the first integrator 102, and a resistor R5 is coupled between a second inputting terminal of the non-inverting buffer 101 and a signal inputting terminal of the second integrator 103.

The above description is made on embodiments of the present invention. However, the embodiments are not intended to limit scope of the present invention, and all equivalent implementations or alterations within the spirit of the present invention still fall within the scope of the present invention.

What is claimed is:

1. A design method for feedforward active noise control system, comprising following steps:

(1) recording a real environmental noise to generate a recorded real environmental noise;

(2) providing a first noise collecting system to receive the recorded real environmental noise, so as to convert the recorded real environmental noise to a first analog reference signal, and then generating a first digital reference signal and a digital target signal;

(3) transmitting, by the first noise collecting system, the first digital reference signal and the digital target signal to a first system identifying unit having a first adaptive filter, and then completing an adaptive system identification of the first adaptive filter by the first system identifying unit;

(4) providing a second noise collecting system to receive the first analog reference signal, and then also generating one said first digital reference signal and one said digital target signal;

(5) transmitting, by the second noise collecting system, the first digital reference signal and the digital target signal to a second system identifying unit having a second adaptive filter, and then completing an adaptive system identification of the second adaptive filter by the second system identifying unit;

(6) converting the second adaptive filter to an analog filter by using a system identification tool, wherein the analog filter is a low-order filter; and (7) establishing said feedforward active noise control system comprising: a circuit of the analog filter, a first pre-amplifier unit coupled to the circuit, a first microphone coupled to the first pre-amplifier unit, a mixer coupled to the circuit and an audio signal, and a loudspeaker coupled to the mixer.

2. The design method of claim 1, wherein the second noise collecting system comprises:

a noise source for broadcasting the recorded real environmental noise by a form of an environmental noise signal;

a first audio collecting device, being disposed at a position so as to face a non-audio broadcasting side of an audio broadcasting device, thereby collecting the environmental noise signal; wherein the non-audio broadcasting side of the audio broadcasting device faces a quiet zone;

a first pre-amplifier, being coupled to the first audio collecting device, and being used for applying a signal pre-amplifying process to the environmental noise signal, so as to output the first analog reference signal;

a second audio collecting device, being disposed at a center position of the quiet zone, so as to collect a first audio signal in the quiet zone;

a second pre-amplifier, being coupled to the second audio collecting device, and being used for applying a signal pre-amplifying process to the first audio signal;

a first A/D conversion circuit, being coupled to the first pre-amplifier for converting the first analog reference signal to the first digital reference signal; and a second A/D conversion circuit, being coupled to the second pre-amplifier for converting the first audio signal to the digital target signal.

3. The design method of claim 2, wherein the first noise collecting system also comprises a second pre-amplifier, a first A/D conversion circuit, and a second A/D conversion circuit, and further comprises:

an analog filter, receiving the first analog reference signal, and being also coupled to the audio broadcasting device.

4. The design method of claim 3, wherein the first system identifying unit comprises:

the foregoing first adaptive filter, receiving the first analog reference signal;

a first adaptive algorithm unit, being coupled to the first adaptive filter, and receiving the first digital reference signal; and a first digital subtracter, being coupled to the first adaptive algorithm unit and the first adaptive filter, and receiving the digital target signal;

wherein the first adaptive filter produces a first digital output signal based on the first digital reference signal, and the first digital subtracter applying a subtraction operation to the first digital output signal and the digital target signal so as to produce a first digital error signal;

wherein the first adaptive algorithm unit adaptively modulates at least one filter parameter of the first adaptive filter according to the first digital error signal and the first digital reference signal, thereby making the first digital error signal approach zero.

5. The design method of claim 4, wherein the second system identifying unit comprises:

the foregoing second adaptive filter, receiving the first digital reference signal, and also generating a first digital output signal;

two of the foregoing first adaptive filters, wherein one of the two first adaptive filters is coupled to the second adaptive filter for receiving the first digital output signal so as to generate a second digital output signal, and the other one first adaptive filter being coupled to the first digital reference signal so as to generate a second digital reference signal;

a second digital subtracter, being coupled to the digital target signal and the second digital output signal; and a second adaptive algorithm unit, being coupled to the second adaptive filter, the second digital reference signal, and the second digital subtracter;

wherein the second digital subtracter applies a subtraction operation to the second digital output signal and the digital target signal, so as to produce and transmit a second digital error signal to the second adaptive algorithm unit;

wherein the second adaptive algorithm unit adaptively modulates at least one filter parameter of the second adaptive filter according to the second digital error signal and the second digital reference signal, thereby making the second digital error signal approach zero.

6. The design method of claim 5, wherein the system identification tool is a mathematical program, and the mathematical program being C programming language.

7. The design method of claim 5, wherein the circuit comprises a plurality of low-order filters coupled to each other by a cascade connecting way.

8. The design method of claim 5, wherein the first adaptive filter and the second adaptive filter are both a finite impulse response (FIR) filter, and the analog filter being an infinite impulse response (IIR) filter.

9. The design method of claim 5, wherein the first system identifying unit utilizes following mathematical formulas to complete the adaptive system identification of the first adaptive filter:

$$y(n) = \sum_{l=0}^{L-1} \hat{S}_l(n) \cdot x(n-l); \tag{I}$$

$$e_1(n) = d(n) - y(n); \text{ and} \tag{II}$$

$$\hat{S}_l(n+1) = \hat{S}_l(n) + \mu x(n-1) e_1(n); \tag{III}$$

wherein y(n) is the first digital output signal, d(n) being the digital target signal, x(n) being the first digital reference signal, e1 (n) being the first digital error signal, $\hat{S}_1(n)$ being a weight vector, μ being a step size of the first adaptive filter, and L being a length of the first adaptive filter.

10. The design method of claim 9, wherein the second system identifying unit utilizes following mathematical formulas to complete the adaptive system identification of the second adaptive filter:

$$y(n) = \sum_{l=0}^{L-1} w_l(n) \cdot x(n-l); \tag{IV}$$

$$e_2(n) = d(n) - y'(n); \tag{V}$$

$$x'(n) = \sum_{m=0}^{M-1} \hat{S}_m(n) \cdot x(n-m); \text{ and} \tag{VI}$$

$$w_l(n+1) = w_l(n) + \mu x'(n-1) e_2(n); \tag{VI}$$

wherein (n) is the first digital output signal, y'(n) being the second digital output signal, d(n) being the digital target signal, x(n) being the first digital reference signal, x'(n) being the second digital reference signal, e2(n) being the second digital error signal, $w_l(n)$ being a weight vector, $\hat{S}_m(n)$ being a weight vector, μ being a step size of the second adaptive filter, and L and M being both a filter length.

* * * * *